US005704292A

United States Patent [19]

Rebeaud

[11] Patent Number: 5,704,292

[45] Date of Patent: Jan. 6, 1998

[54] BELT TRANSPORT ARRANGEMENT FOR A MACHINE TRANSFERRING IMAGES ONTO SHEETS FROM THE BELTS

[75] Inventor: Jean-Claude Rebeaud, Le Mont-Sur-Lausanne, Switzerland

[73] Assignee: Bobst SA, Lausanne, Switzerland

[21] Appl. No.: 639,734

[22] Filed: Apr. 29, 1996

[30] Foreign Application Priority Data

Apr. 28, 1995 [CH] Switzerland ..... 01224/95

[51] Int. Cl.[6] ..... B41F 1/00

[52] U.S. Cl. ..... 101/477; 101/DIG. 31; 400/693; 400/234

[58] Field of Search ..... 101/216, 415.1, 101/477, DIG. 31, 27; 400/234, 613, 692, 693, 191

[56] References Cited

U.S. PATENT DOCUMENTS 1,737,593 12/1929 Lange ..... 101/DIG. 31

4,860,028 8/1989 Ogawa ..... 101/DIG. 31

4,973,175 11/1990 Koike et al. ..... 400/693

*Primary Examiner*—Christopher A. Bennett

*Attorney, Agent, or Firm*—Hill, Steadman & Simpson

[57] ABSTRACT

An arrangement for transporting metallized belts or bands in a machine for transferring the metallized images from the belts or bands onto a sheet comprises a support for the belt supply bobbins, advance rollers for intermittent unrolling and advancing the belts, guide rollers for guiding the belts between the platens and then a discharge state around one of the platens of the press, a tension roller for placing the belts under tension and an arrangement for removing the worn belts from the machine. The advance rollers are arranged in a parallel group downstream from the platen press and slightly above a plane of transport for the sheets through the press. The machine includes at least one window provided in at least one of the lateral walls of the frame of the machine above this group of advance rollers so that an operator may easily obtain access to the rollers for replacement of the bands and/or adjusting the position of the bands.

14 Claims, 2 Drawing Sheets

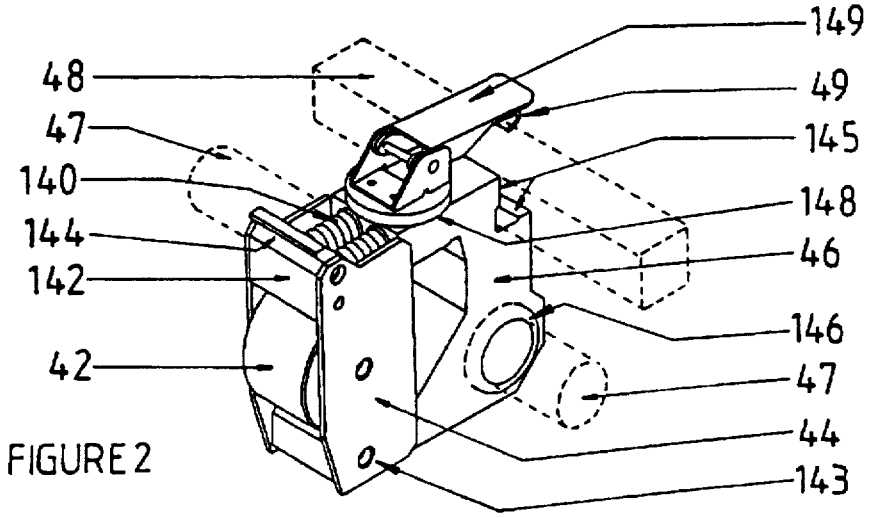
FIGURE 2
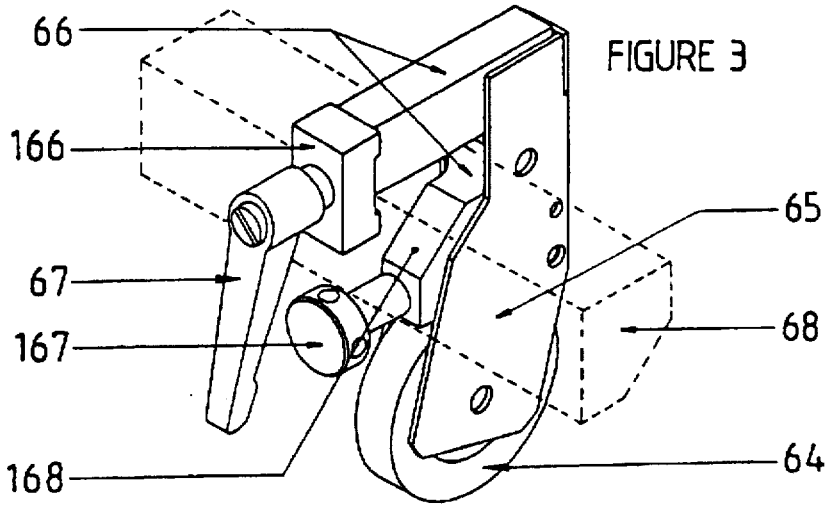
FIGURE 3
FIGURE 4
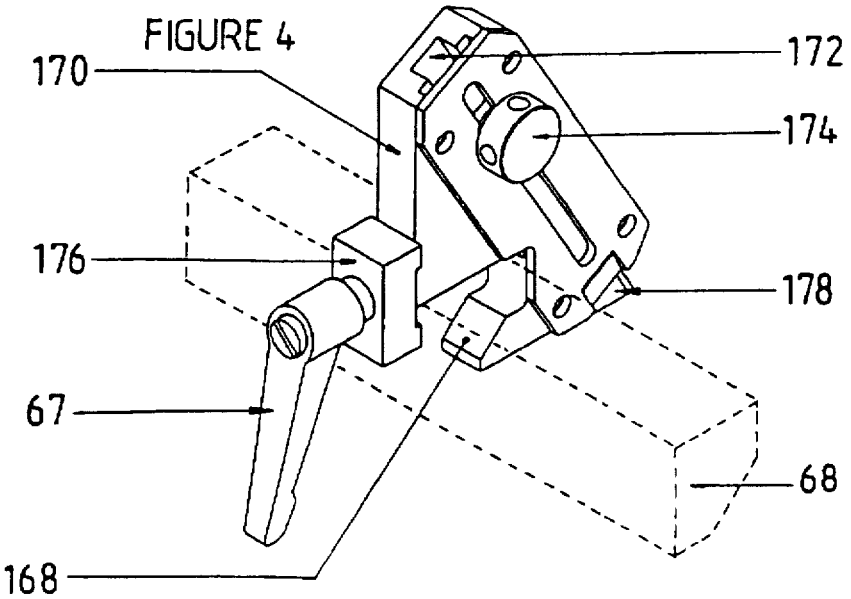

BELT TRANSPORT ARRANGEMENT FOR A MACHINE TRANSFERRING IMAGES ONTO SHEETS FROM THE BELTS

BACKGROUND OF THE INVENTION

The present invention is directed to an arrangement for transporting metallized belts in a machine for transferring metallized images from the belts onto sheet elements, such as sheets of cardboard, paper or plastic material. More particularly, the invention concerns a machine comprising a platen press having a pair of platens between which a sheet is led so that a metallized film coming from a belt conducted between the sheet and one of the platens can be printed onto the sheet according to given patterns.

A printing machine of this type usually comprises an input station in which is installed a stack of sheets, each sheet being successively removed from the top of the stack in order to be sent to a layout board. On the layout board, each sheet is placed in position against front stops and lateral stops before being grasped at a front edge by a series of clamps or gripping fingers mounted along a transverse bar which, in turn, is attached at each end to continuous chain trains which lead the bar and, thus, the sheet along a transport plane into subsequent processing stations. The processing stations may be one or several platen printing presses, possibly followed by a cutting press, which will be followed by a waste ejection station. These processing stations are finally followed by a receiving or delivery station in which each sheet is released by the gripping fingers and falls squarely onto a top of a stack that accumulates on an output pallet.

An independent transport arrangement for parallel metallized belts or bands successively comprises a belt supply bobbin support, means for the intermittent unrolling and advancing of the belts, guiding means for guiding these belts in a parallel fashion in the direction of the movement of the sheets between the platens and then guiding them in a disengaged state around one of the platens of the press to a tension mechanism for placing the belts under tension at least along their trajectory between the platens, and an arrangement for the removal of the worn or used belts from the machine, usually through a lateral window. The metallized belts having an identical speed of intermittent unwinding pass from the same advancing and unrolling means, while belts having a different speed pass through second or third separate unrolling and advancing means, with the tension mechanism being controlled, in this case, as a function of the highest speed.

The small metallized belt bobbins are each fixed on an associated lever, which levers are mounted on horizontal crossbeams. The levers are transversely movable and can be stopped at a desired position by means of fixing screws. Each bobbin is fixed in its lever by means of a chuck with extensible diameter, having a controllable braking system permitting the belt to unwind more or less freely. The large bobbins are held by rigid transverse axles, whose ends rest in base plates provided on each side of the internal walls of the frame of the machine.

Leaving the bobbin, a metallized belt passes around a part of a circumference of an advance roller for intermittently unrolling and advancing the belt and is urged against the surface of this roller more or less firmly by an idler which is pressed by a spring so as to clamp the belt securely on the surface of the advance roller. The support of the idler is also movable along a crossbeam, as a function of the position of the belt. There are at least as many pressure idlers as there are belts passing around the advance rollers. For the transport of belts having a great width, it is preferable to use several pressure idlers per belt. In addition, there may be several advance rollers, one for each desired profile of intermittent unwinding speed. After the advance roller, the parallel belts are next guided between the platens and then around an upper platen by means of several guiding and return rollers.

The belt, having described a U-shaped trajectory lying around the upper platen, is then taken by a tension roller driven continuously at a speed appreciably greater than the advance speed of the fastest belt. This belt is also clamped more or less firmly against the tension roller by at least one pressure idler, whose pressure can be controlled. The support of the idler can also slide along a crossbeam and can be fixed at the desired position by a set screw. For a wide belt, it is preferable to use several pressure idlers.

After leaving the tension roller, the belt is finally guided at right angles around a return bar in the direction toward a lateral window in the frame of the machine, where it is ejected by two rotating brushes so as to fall into a tube or bag. Preferably, cutters are situated close to the tension roller to cut the belt longitudinally into several strips. For reasons of cumbersomeness, the base plates of the axles traversing the large bobbins and/or the graduated crossbeams bearing the small bobbins, as well as the advance rollers for the unrolling and the intermittent advance of the belts, are situated in the upper part of the station following the platen press. The tension roller and the return bars are often located above the platen press and slightly downstream thereof. The difficult access to these parts of the machine, usually through the top, makes the replacement of the belts in the course of production, or the changing of the configuration of the belts from one production run to the next run, particularly tiresome and long, which correspondingly increases the "dead time" during which the machine is not in use and also increases the risk of accidents.

SUMMARY OF THE INVENTION

The object of the present invention is to provide a belt transport arrangement which is constructed so as to permit an installation of belts and operation thereon in an effective, easy, rapid and sure manner at all the strategic points of the path of the belts. The design of the parts making up the arrangement must remain as simple as possible in order to ensure better long-term reliability and a reasonable cost of production, while taking into account ergonomic considerations that simplify their handling and that of the belts.

These objects are achieved by means of an arrangement in which the parallel advance rollers are grouped directly downstream from a platen press and slightly above the transport plane of transport of the sheets, and due to the fact that at least one window is provided in at least one of the lateral walls of the frame of the machine above this group of advance rollers.

According to the preferred embodiment, the advance rollers are arranged one after the other in a plane parallel to the transport plane of the sheets and their advance direction.

Advantageously, a lower edge of the window is situated slightly above the plane of the advance rollers, and the upper edge is situated at least above the tension roller installed above a downstream edge of the press and close to an upstream vertical edge of the window, or above the bobbins installed in an upper downstream part of the machine, for example in the following station, and close to a downstream vertical edge of the window.

In this way, the regrouping of the advance rollers in a horizontal plane near the press and the opening of a window at this point makes these rollers and their associated idlers particularly accessible. The operator working in the frame of the window can easily pull the belts from the bobbins arriving from the side of the downstream vertical edge of the frame and pass them onto the advance roller concerned by leaning toward the lower edge and then into the press. Once the belts are passed around the upper platen of the press, the operator can easily recover them at the upstream vertical edge of the window in order to pass them around the tension roller. The installation of the supports for the different idlers and the subsequent placing of the idlers into operation is made rapid by their accessibility.

The departure and arrival of the return bend of the chain train, sending the clamping bars from the downstream part of the machine toward the upstream part, usefully takes place at an angle of incidence greater than 45°, and preferably 60°, to the horizontal so that the chain train passes above the upper edge of the window.

Advantageously, the intermittent driving of each advance roller is effected by an associated electric motor, mounted immediately under the roller against one of the downstream walls of the frame of the machine. This motor is connected directly to a drive pulley mounted at a corresponding end of the roller by means of a belt.

Usually, the support of the idler of the advance roller comprises a carriage that slides along a crossbeam, on which it can be fixed at any point, a lever is pivotably mounted on the carriage at a first end and carries, at its median part, the idler, as well as a spring acting between the carriage and the second end of the lever in order to urge the idler against the advance roller facing it. According to the preferred embodiment, the support also comprises a hook that can be advanced or drawn back by a handle, and this hook is provided in order to grasp the second end of the lever and pull the idler away from the roller against the compression of the spring. In this way, a given idler can be rapidly placed into a deactivated condition or into an operable condition.

Advantageously, the carriage for the support slides freely along a first crossbeam and can be fixed against a second crossbeam extending parallel to the first crossbeam by means of a hook which, by means of a handle, can be advanced so as to pass behind the second crossbeam, then drawn back for clamping. It is thus unimportant whether the first support crossbeam is not accessible, as long as the hook and the second crossbeam are. Preferably, the first crossbeam has a circular cross section and traverses the carriage in its lower part, and the second crossbeam has a rectangular section and is accepted by a notch provided in the upper part of the carriage, with the height of the notch being slightly greater than that of the second crossbeam. When the fixing hook is released, the carriage falls into a slight pivoting, being held by a lower surface of the notch coming to rest against a lower surface of the second crossbeam. By lifting the carriage manually, it is possible to slide it along the first crossbeam very easily, in particular due to its circular cross section, which avoids any sticking.

Preferably, the grasping hook at the end of the lever and the hook for fixing against the second crossbeam are one and the same hook and are mounted by a rotatable mobile journal on the carriage.

The support for the idler for the tension roller, as well as the support for the cutting blades, usefully present a trapezoidal passage that corresponds with a support crossbeam having an identical cross section. Thus, a fixing screw and a control button for the force of the support of the idler or the positioning of the cutter are necessarily on one predetermined side, for example in the direction of the vertical edge of the access window.

Other advantages and features of the invention will be readily apparent from the following description of the preferred embodiments, the drawings and claims.

BRIEF DESCRIPTION OF THE DRAWINGS

FIG. 2 is a perspective view of a support for an idler of an advance roller specifically designed for the arrangement according to FIG. 1;

FIG. 3 is a perspective view of a support for an idler for a tension roller specifically designed for the arrangement according to FIG. 1; and FIG. 4 is a perspective view of a cutter support specifically designed for the arrangement according to FIG. 1.

DESCRIPTION OF THE PREFERRED EMBODIMENTS

Figure 1:
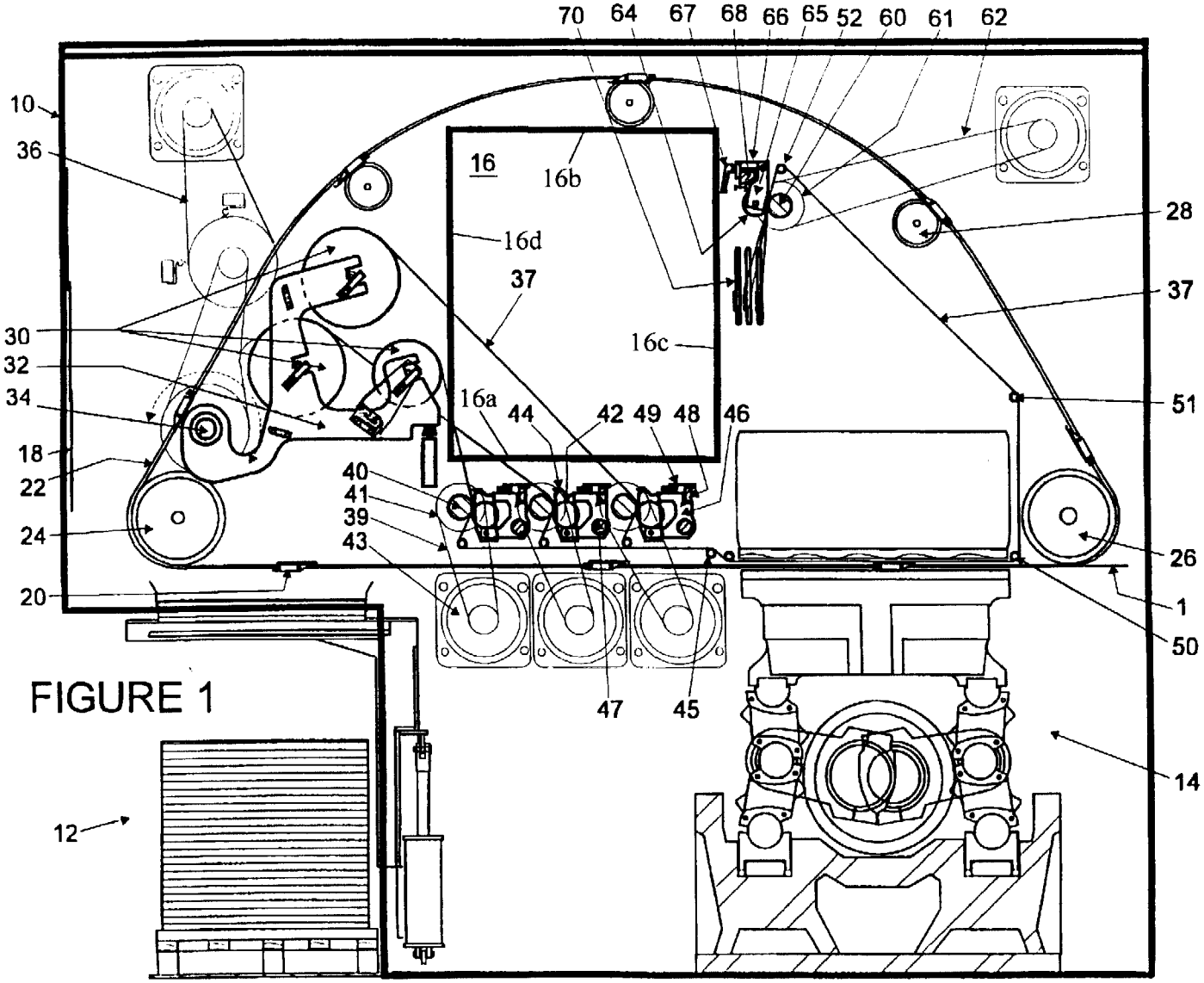
FIG. 1 is a schematic view in longitudinal cross section of an installation of a belt transport arrangement according to the invention and a machine for transferring metallized images from a belt onto a sheet.

The principles of the present invention are particularly useful when incorporated in a transfer machine, generally indicated at 10 in FIG. 1. The transfer machine 10 comprises a platen press 14 having an upper platen on a lower surface of which blocks are fitted, as well as a lower, vertically mobile supporting platen on the upper surface, on which are fixed counterblocks. Clamping bars 20, having gripping fingers or clamps, grip the front edge of a sheet 1, which has first been aligned in a layout board (not shown) situated upstream of the platen press 14, which would be to the right side in FIG. 1. The clamping bars 20 lead each sheet in a transport plane, at first, through the platen press 14, then into a last station called a receiving or delivery station 12, in which the sheets are released, properly squared, and dropped onto the top of an output stack.

These clamping bars 20 are held on each end by a pair of chain trains 22. Each chain train describes a bend along the internal surface of the corresponding lateral wall of the machine 10. More precisely, the clamping bars follow a path moving in a horizontal transport plane from an upstream driving wheel or gear 26 to a downstream return wheel or gear 24 and then the path is guided by small wheels 28 to move upward into the upper part of the machine, permitting the clamping bars to be brought back to the point of the upstream driving gear 26 to grasp a new sheet.

More particularly, according to the present invention, the return path of the chain train 22 makes a bend high enough to pass above a lateral window 16 arranged approximately in the middle of the upper half of each lateral wall of the machine. As shown, this return bend follows the shape of a carapace of a tortoise and presents a very large angle of incidence at the start, close to the return gear 24, and, at its arrival, close to the driving gear 26. The angles are greater than 45° and, as illustrated, are in the order of 60° to the horizontal. More particularly, the lower edge **16*a* of the window 16 is situated about at the level of the waist of an operator, and an upper edge 16*b* is situated approximately at the level of the head of the operator. The width of the window 16 between an upstream vertical edge 16*c* and a downstream vertical edge 16*d*** is slightly larger than that of the shoulders of an operator.

This transfer machine is specifically designed to enable the deposit of special pigments, such as metallic pigments, coming from a belt or band 37 from a bobbin 30. This belt or band 37 is sequentially advanced by advance rollers 40, then guided between the sheet 1 and an upper supporting platen of the press 14 by diverting and guiding rollers 45, 50 and then is recirculated and directed by rollers 51, 52 toward a tension-inducing roller 60 before being laterally evacuated from the machine by passage around a diverting bar 70.

According to the invention, it is preferred that the supply bobbins 30 are provided in the upper part of the last station of the machine, for example the delivery station 12, in particular, between the start of the return path of the chain train 22 and the downstream vertical edge **16*d* of the window 16. In particular, the support axles of these bobbins 30 are held on each side by a pair of parallel identical loading arms 32, each being rotatable around an axis of rotation on an axle 34 in a plane parallel to the internal surfaces of the lateral walls of the machine. Thus, by means of rotation on the order of 130° in the downstream direction, which is shown in FIG. 1 as the counter-clockwise direction, these loading arms can shift the bobbins to the exterior of the downstream surface or wall of the machine by passing through a window 18, which is closed by vertically sliding telescopic plates. For this purpose, the axle 34 of one of the loading arms 32 is fixedly attached to a wheel or gear that can be driven by an arrangement 36 comprising an electric motor and a transmission chain, which includes an intermediate gear or pulley and a reduction gear which is connected to the motor and whose output is connected to the gear on the axle 34**.

The metallized belts or bands 37, intended to be consumed at an identical rate, are directed toward a common unrolling and advance roller 40 belonging to a triplet of which each of the other rollers are imparted and advance at a rate different from the other belts. More particularly, according to the invention, this triplet of rollers which extend parallel to one another is grouped in a horizontal plane one after the other, and this plane is situated slightly above the transport plane of the passage of the sheets 1 to which it is parallel. In addition, the plane of the three rollers is situated directly at the exit of the platen press 14, slightly below a lower edge **16*a* of the lateral window 16. The main advantage of this original construction is that the advance rollers 40 are directly accessible from above by simply leaning through the lateral window 16. A further advantage is that it is possible to arrange a group of three electric motors 43, respectively, driving each roller 40 by means of a chain or belt 39 engaged with a drive wheel or pulley 41 attached to the end of the corresponding roller. This group is constructed according to the horizontal line situated just below the transport plane of passage of the sheets 1 and between the platen press 14 and the delivery station 12**. It is, thus, advantageously possible to make use of "brushless" electric motors, which have a very precise step-by-step advance.

Another advantage of the arrangement of the advance rollers 40 under the window 16 just downstream from the platen press 14 is the use of special support for the support idlers 42, which are better visible in the perspective view of FIG. 2. According to the present invention, each support is based on a carriage 46, which has a circular orifice 146 provided in the lower part, which telescopically receives a first circular supporting crossbeam 47. This sliding takes place along a second rectangular crossbeam 48 engaged in a notch 145, which is arranged in the upper upstream corner of the carriage and has two flat surfaces. The dimensions of this carriage 46 are such that the lower horizontal flattened surface is separated by 1 mm to 3 mm from the lower surface of the crossbeam 48, and the upper vertical flat surface corresponds with the downstream vertical surface of the same crossbeam. The lower downstream edge of this carriage 46 supports, for pivotable rotation, a lever 44, which is composed of two lateral plates, which are held together at their lower part by an axle or pin which forms a pivot point 143 for the lever on the carriage. These plates are connected at their upper part by a crosspiece 142. A support idler 42 is mounted for rotation in the median part of the lever plates 44 by an axle. In addition, the crosspiece 142 constitutes a stop for a first end of a pair of compression springs 140, whose other ends are supported against an upper part of the carriage 46. These springs, thus, urge the idler 42 in support against the unrolling and advance cylinder or advance roller 40, which is mounted to face the idler 42.

More particularly, according to the present invention, the upper surface of the carriage 46 is provided with a journal which is rotationally mobile in a horizontal plane. This journal supports a hook 49 that can be elastically advanced or drawn back by means of a handle 149.

The hook 49 enables, first, the locking of the carriage 46 in the desired position along the crossbeam 47 by clamping the vertical surface of a notch 145 against the second crossbeam 48. For this purpose, and as shown in FIG. 2, the hook 49 is passed behind the downstream vertical surface of the crossbeam 48 and then closed by folding down the handle 149 over the hook.

This same hook 49 subsequently enables the deactivation of the idler 42 by pulling the crosspiece 142 toward the body of the carriage 46 against the compression of the springs 140. For this purpose, the hook 49, in its extended position, is engaged in a hooking groove 144 provided in the crosspiece 142 and then the hook is pulled after the folding down of the handle 149. At that point, the carriage 46 will tilt slightly forward until a lower flattened surface of the notch 145 makes contact with the crossbeam 48. An operator passing an arm through the lateral window can then easily manually grasp the carriage 46, so that after it has been lifted up slightly, it can be slid freely along the circular crossbeam 47 in an idle position or in a new position for use. In the latter case, it suffices for the operator to lift the handle 149 in order to disengage the hook 49 from the groove 144, to turn the hook a half-turn in order to re-engage it behind the crossbeam 48 and to fold down the handle to clamp the carriage against the crossbeam 48.

As shown in FIG. 1, the diverting and guiding rollers 45, 50, 51 and 52 will send the metallized belt toward the tension roller 60, with its corresponding support idlers 64 situated near an upper part of an upstream edge **16*c* of the lateral window 16. As shown more clearly in FIG. 3, the support idler 64 is mounted at a lower end of a lever 65, which is mounted rotationally on its upper part to a support carriage 66 fixed to a crossbeam 68. This lever is pushed by an internal elastic biasing means, such as a spring, which has a position of a stop in the body 66 which is adjustable by means of a knob 167 for modifying the support force. This support carriage 66 is fixed in a predetermined position along the crossbar 68 by a lock 166 closed by means of a fixing screw ending in a handle 67**.

More particularly, according to the present invention, the transverse cross section of the crossbeam 68 and of the internal passage 168 of the carriage 66 is non-symmetrical, for example is trapezoidal, in order to impose a mounting direction of the carriage. Thus, the handle 67 and the controlling knob 167 are directed toward the side of the carriage which is facing the lateral window 16.

Parallel to the idler 64, there is also mounted on this same crossbeam 68 cutter blades 178, which permit the longitudinal cutting of the metallized belt 37 before its ejection from the machine. As shown in FIG. 4, the cutter blade support comprises a carriage 170 having an internal housing 172 for the blade, whose vertical position can be fixed by a clamping screw ending in a knob 174 that slides along a groove of the housing. As previously, this carriage 170 can be fixed in a predetermined position by closing a lock 176 by means of a fixing screw and handle 67. The passage 168 of the carriage 170 receives the crossbeam 68 and is also trapezoidal so that the handle 67 and the knob 174 are necessarily oriented to the side of the lateral window 16.

As described hereinabove, the construction of the unrolling and advance rollers 40 in a plane slightly above the transport plane of passage of the sheets directly at the exit of the platen 14, as well as the opening of the lateral window 16 just above these advance rollers and the arrangement of the tension rollers close to an upstream vertical edge 16*c* of the window, enables a remarkable accessibility of the belt or band transport arrangement at all strategic points. Thus, a rapid and easy implementation of this arrangement occurs.

Preferably, the supply bobbins are arranged in the upper part of the last station of the machine 10, for example the delivery station 12, in order to permit their loading through the window 18 provided in the downstream end of the machine. The presence of the lateral window 16 makes it possible, by leaning against the downstream vertical edge 16*d*, to pull the belts or bands 37 away from their bobbin very easily, in addition, by utilizing a grasping tool to pass the belts beyond the possible intermediate station, The systematic orientation toward the window 16 of the clamping handles of the carriages for the idlers 42 of the advance rollers or the idlers 64 of the tension rollers simplifies the operator's work and, thus, significantly reduces the dead time in which the machine is idle.

Although various minor modifications may be suggested by those versed in the art, it should be understood that I wish to embody within the scope of the patent granted hereon all such modifications as reasonably and properly come within the scope of my contribution to the art.

I claim:

1. In a transport arrangement for metallized belts in a machine for transferring metallized images onto sheet elements, said machine comprising a platen press having an upper fixed platen and a lower mobile platen, between which platens a sheet is led in a transport plane so that a metallized film coming from a belt conducted between the sheet and one of the platens of the platen press can be printed onto the sheet according to a given pattern, the sheets being moved in the transport plane by bars with clamps being attached to driven lateral chain trains, said arrangement successively comprising a belt supply bobbin support, advance rollers for the intermittent unrolling and advancing of the belts, guide rollers for guiding the belts between the platens and then guiding them in a disengaged state around one of the platens of the press, a tension roller for placing the belts under tension and an arrangement for the removal of the worn belts from the machine, the improvements comprising the advance rollers for unwinding and advancing being grouped directly downstream from the platen press and slightly above the transport plane of the sheet, each advance roller having an idler for applying pressure to a belt contacting the advance roller, means for mounting the idler, said means for mounting including a first crossbeam, a carriage slidable along said first crossbeam, a lever mounted by a pivotable arrangement on the carriage at a first end and supporting the idler for rotation at a median part of the lever, a spring acting between the carriage and a second end of the lever to bias the idler against the advance roller, a hook movable between an advance and drawn-back position by a handle, said hook being provided for grasping the second end of the lever and for pulling the idler away from the roller against the compression of said spring to an inoperative position, and the machine having at least one window being provided in one of the lateral walls of the frame of the machine above the group of advance rollers.

2. In a transport arrangement according to claim 1, wherein the advance rollers are arranged one after the other in a plane parallel to the transport plane of the sheet.

3. In a transport arrangement according to claim 2, wherein the lower edge of the window is situated slightly above the plane of the advance rollers and the upper edge is situated at least above the tension rollers installed above a downstream edge of the press and close to an upstream vertical edge of the window, the bobbins for the belts being installed in an upper downstream part of the machine in a following station and close to a downstream vertical edge of the window.

4. In a transport arrangement according to claim 1, wherein the start and arrival of the return bend of the chain trains that send the clamping bars from a downstream part of the machine toward the upstream part form an angle of incidence greater than 45° with a horizontal plane.

5. In a transport arrangement according to claim 1, wherein intermittent driving of each of the advance rollers is obtained by an associated electric motor mounted under the roller against one of the downstream walls of the frame of the machine, said motor being connected by a belt to a driving pulley mounted at the corresponding end of the advance roller.

6. In a transport arrangement according to claim 1, wherein the tension roller includes at least one pressure idler and means for mounting the pressure idler includes a support carriage having a trapezoidal passage corresponding to a trapezoidal cross section of a support crossbeam, said carriage including a fixing screw for clamping the carriage in a fixed position along the crossbeam and a control knob for changing the support force of the idler.

7. In a transport arrangement according to claim 6, which includes a carriage for a cutter blade, said carriage having a trapezoidal passage matching the trapezoidal cross section of said crossbeam, said carriage being provided with a fixing screw to enable clamping the carriage at a fixed axial position along the crossbeam, said carriage having a positioning knob for adjusting the position of the cutter in said carriage.

8. In a transport arrangement according to claim 1, which includes a support for a cutter blade, means for mounting the support adjacent the tension roller, said means for mounting including a crossbeam having a trapezoidal cross section, a carriage having a trapezoidal passage corresponding to the cross section of the crossbeam, a fixing screw for clamping the carriage on the crossbeam in a fixed axial position, said carriage having a knob for adjusting the position of the cutting blade in said carriage.

9. In a transport arrangement according to claim 1, wherein the carriage slides freely along the first crossbeam and can be fixed against a second crossbeam extending parallel to the first crossbeam by means of a hook which can be shifted by a handle between an advanced position to pass behind the second crossbeam to a drawn-back position for clamping the carriage to the crossbeam.

10. In a transport arrangement according to claim 9, wherein the grasping hook at the end of the lever and the hook for fixing against the second crossbeam are one single hook mounted on a rotatable mobile journal on the carriage so as to be movable from a position for grasping the second end of the lever to a second position for grasping the second crossbeam.

11. In a transport arrangement according to claim 9, wherein the first crossbeam has a circular cross section and extends through a circular passage in a lower end of the carriage, the second crossbeam has a rectangular cross section and is received in a notch in the upper part of the carriage, the height of said notch being slightly greater than that of the second crossbeam so that a lower edge of the notch is spaced from the crossbeam.

12. In a transport arrangement for metallized belts in a machine for transferring metallized images onto sheet elements, said machine comprising a platen press having an upper fixed platen and a lower mobile platen, between which platens a sheet is led in a transport plane so that a metallized film coming from a belt conducted between the sheet and one of the platens of the platen press can be printed onto the sheet according to a given pattern, the sheets being moved in the transport plane by bars with clamps being attached to driven lateral chain trains, said arrangement successively comprising a belt supply bobbin support, advance rollers for the intermittent unrolling and advancing of the belts, guide rollers for guiding the belts between the platens and then guiding them in a disengaged state around one of the platens of the press, a tension roller for placing the belts under tension and an arrangement for the removal of the worn belts from the machine, the improvements comprising the advance rollers for unwinding and advancing being grouped directly downstream from the platen press and slightly above the transport plane of the sheet, the tension roller including at least one pressure idler and means for mounting the pressure idler including a support carriage having a trapezoidal passage corresponding to a trapezoidal cross section of a support crossbeam, said carriage including a fixing screw for clamping the carriage in a fixed position along the crossbeam and a control knob for changing the support force of the idler, and the machine having at least one window being provided in one of the lateral walls of the frame of the machine above the group of advance rollers.

13. In a transport arrangement according to claim 12, which includes a carriage for a cutter blade, said carriage having a trapezoidal passage matching the trapezoidal cross section of said crossbeam, said carriage being provided with a fixing screw to enable clamping the carriage at a fixed axial position along the crossbeam, said carriage having a positioning knob for adjusting the position of the cutter in said carriage.

14. In a transport arrangement for metallized belts in a machine for transferring metallized images onto sheet elements, said machine comprising a platen press having an upper fixed platen and a lower mobile platen, between which platens a sheet is led in a transport plane so that a metallized film coming from a belt conducted between the sheet and one of the platens of the platen press can be printed onto the sheet according to a given pattern, the sheets being moved in the transport plane by bars with clamps being attached to driven lateral chain trains, said arrangement successively comprising a belt supply bobbin support, advance rollers for the intermittent unrolling and advancing of the belts, guide rollers for guiding the belts between the platens and then guiding them in a disengaged state around one of the platens of the press, a tension roller for placing the belts under tension and an arrangement for the removal of the worn belts from the machine, the improvements comprising a support for a cutter blade, means for mounting the support adjacent the tension roller, said means for mounting including a crossbeam having a trapezoidal cross section, a carriage having a trapezoidal passage corresponding to the cross section of the crossbeam, a fixing screw for clamping the carriage on the crossbeam in a fixed axial position, said carriage having a knob for adjusting the position of the cutting blade in said carriage, the advance rollers for unwinding and advancing being grouped directly downstream from the platen press and slightly above the transport plane of the sheet and the machine having at least one window being provided in one of the lateral walls of the frame of the machine above the group of advance rollers.

* * * * *